United States Patent [19]

Davis

[11] Patent Number: 4,842,542

[45] Date of Patent: Jun. 27, 1989

[54] CONNECTOR WITH REMOVABLE LATCH BLOCK AND REMOVABLE LATCH BLOCK THEREFOR

[75] Inventor: Wayne S. Davis, Harrisburg, Pa.

[73] Assignee: AMP Incorporated, Harrisburg, Pa.

[21] Appl. No.: 281,152

[22] Filed: Dec. 7, 1988

[51] Int. Cl.[4] ..... H01R 13/73

[52] U.S. Cl. ..... 439/357; 439/372

[58] Field of Search ..... 439/372, 357, 350, 351, 439/352, 353, 354, 355, 356, 358, 370

[56] References Cited

U.S. PATENT DOCUMENTS

| | | | |
|---|---|---|---|
| 3,714,617 | 1/1973 | Bright et al. | 339/186 |
| 3,824,525 | 7/1974 | Keller | 339/91 |
| 4,168,877 | 9/1979 | Little et al. | 339/103 |
| 4,367,003 | 1/1983 | Frantz | 339/91 |
| 4,568,135 | 2/1986 | Frantz | 339/91 |
| 4,653,828 | 3/1987 | Szczesny et al. | 439/350 |
| 4,709,976 | 12/1987 | Nakama et al. | 439/350 |
| 4,781,615 | 11/1988 | Davis et al. | 439/395 |

FOREIGN PATENT DOCUMENTS

| | | | |
|---|---|---|---|
| 2714409 | 10/1978 | Fed. Rep. of Germany | 439/357 |

OTHER PUBLICATIONS

Pp. 92 & 93 of AMP Catalog 79-546, Rev. 12/84.

Pp. 19, 20, 21 and Cover Sheet of AMP Catalog 73-151, Rev. 3/79.

*Primary Examiner*—Neil Abrams

*Assistant Examiner*—Khiem Nguyen

*Attorney, Agent, or Firm*—David L. Smith

[57] ABSTRACT

A connector (10;12) with removable latch block (24) or a removable latch block (24) for reception in a channel (28) in an electrical connector (10;12) wherein the channel (28) has a wider first region (36) and a narrower second region (38) with the narrower second region (38) opening both onto the wider first region (36) and an exterior surface (40) of the connector (10;12). The latching block (24) has a latching section (54) and a retaining section (52). The latching section (54) includes a latching shoulder (60) to engage latching means on a complementary connector. The retaining section (52) has an enlarged first retaining portion (56) adapted to be slidingly received in the wider first region (36) of channel (28) and a narrower second retaining portion (58) extending from the first retaining portion (56) and adapted to extend through the narrower second region (38) of the channel to interconnect the enlarged first retaining portion (56) with the latching section (54).

16 Claims, 4 Drawing Sheets

CONNECTOR WITH REMOVABLE LATCH BLOCK AND REMOVABLE LATCH BLOCK THEREFOR

BACKGROUND OF THE INVENTION

This invention relates to electrical connectors and in particular to a removable latch block system for securing mated electrical connectors together.

It is often desirable to provide electrical connectors that are adapted to be mated with a latching mechanism to assure that the connectors, when interconnected, remain mated under conditions where one or both of the mated connectors are subjected to forces that could unmate the connectors, but for the latching mechanism.

Latch blocks for bolting to an aperture in a connector flange are known. These latch blocks either require a bolt and nut to secure them to the connector flange or have a threaded bore and can be bolted to the connector flange.

SUMMARY OF THE INVENTION

The present invention relates to a removable latch block system for electrical connectors that provides for a removable latch block to be positioned and secured in a slot in a connector. The removable latch block is retained in the inserted orientation. In accordance with the present invention, an electrical connector having a housing has a channel therein. The channel has a wider first region and a narrower second region, with the narrower second region opening both onto the wider first region and onto an exterior surface of the housing. A latch block having a latching section and a retaining section is adapted to be retained in the channel. The latching section of the latch block has a latching shoulder facing the retaining section. The retaining section has an enlarged first retaining portion slidingly received in the wider first region of the channel. The retaining section also has a narrower second retaining portion extending from the enlarged first retaining portion and through the narrower second region of the channel to interconnect the enlarged first retaining portion and the latching section. Means are provided for retaining the latch block in the channel.

DESCRIPTION OF THE PREFERRED EMBODIMENT

Figure 1:
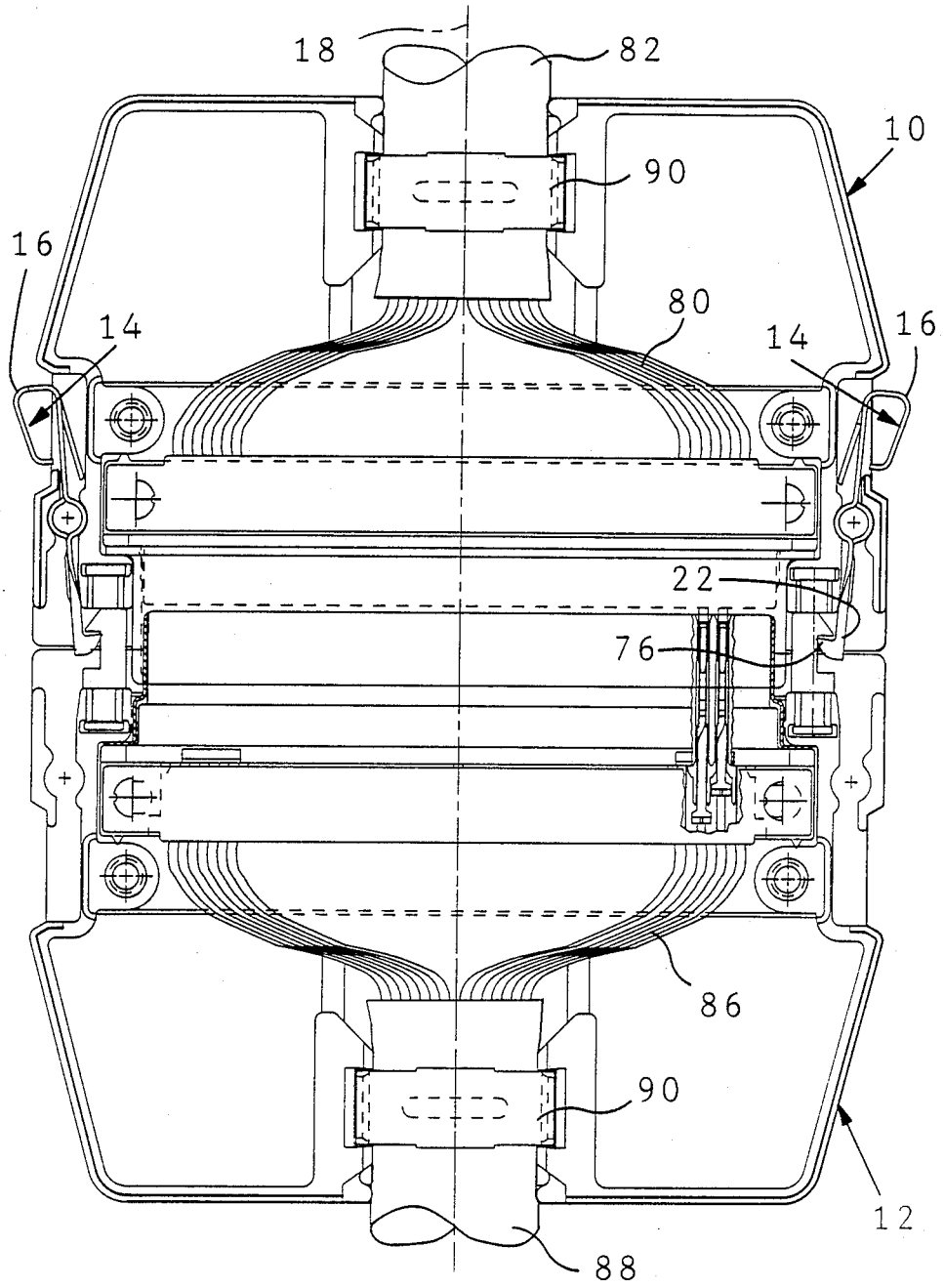
FIG. 1 is a top view depicting plug in receptacle connectors utilizing a removable latch block in accordance with the present invention.
Figure 1A:
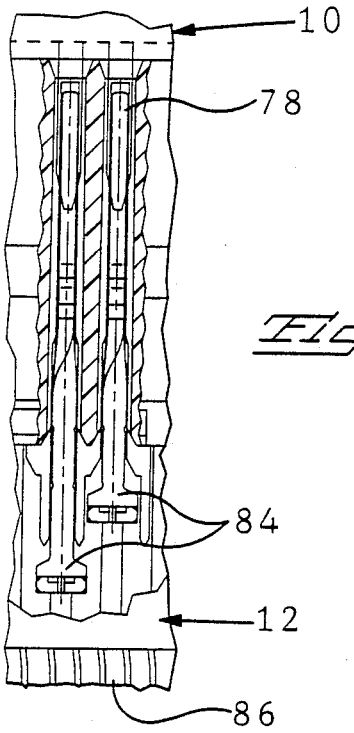
FIG. 1A is an enlargement of a portion of FIG. 1 showing in more detail the contacts in the two connectors.

A cable-to-cable interconnection is shown in FIG. 1 in which plug connector 10 and receptacle connector 12 are mated; with their respective back shells removed. Alternatively, one of the connectors may be a panel or board mounted connector with the other connector being a cable connector, or both of the connectors could be board mounted connectors. Connectors of this type are described in U.S. Pat. No. 4,781,615 and application Ser. Nos. 90,291 and 90,294, both filed Aug. 31, 1987, the disclosures of each of these applications is hereby incorporated by reference. Connector 10 has a pair of pivotally mounted latch arms 14 mounted thereon. As first end 16 of latch arms 14 is pressed toward axis 18, spring 20 is compressed and second latch end 22 is rotated away from axis 18, releasing from removable latch block 24 and permitting connectors 10 and 12 to be unmated. When the first ends of latch arms 16 are released, spring 20 causes latch arm 14 to pivot in the opposite direction, thereby returning to its initial position.

Figure 2:
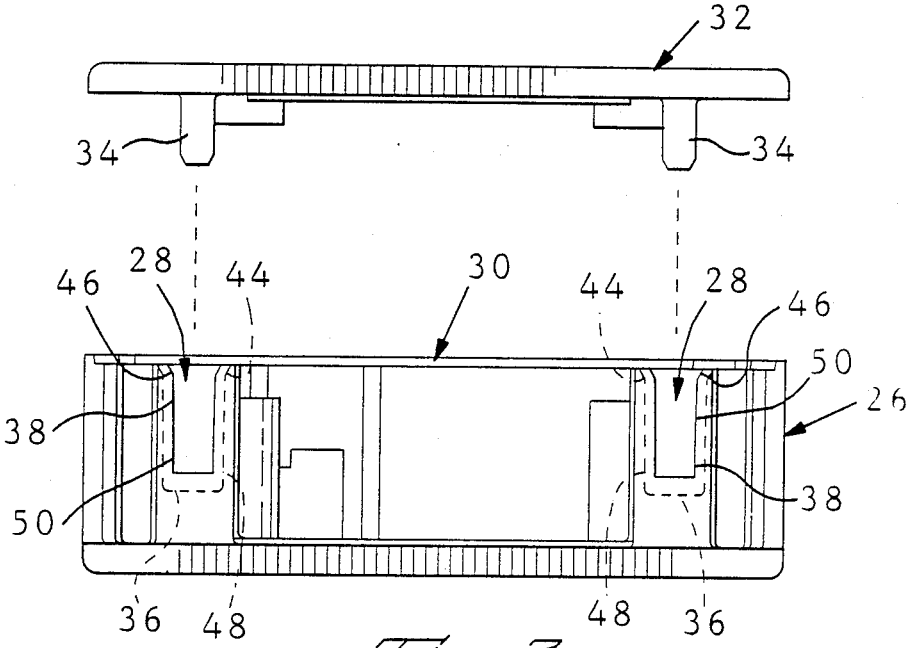
FIG. 2 is a front end view of a lower back shell of FIG. 1 with the cover exploded therefrom.
Figure 3:
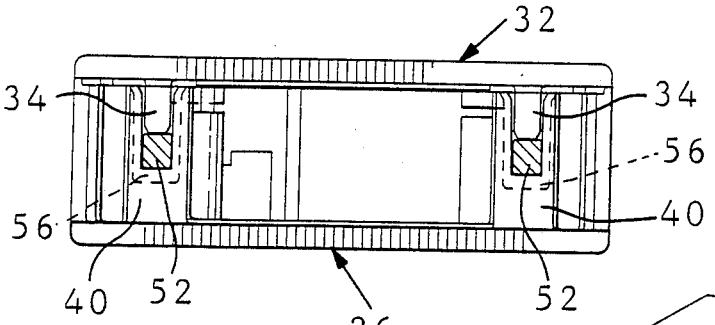
FIG. 3 is the back shell of FIG. 2 with protrusions on the cover securing removable latch blocks, shown in section, in the slots.

As shown in FIG. 2, lower back shell 26 of receptacle connector 12 includes a pair of identical slots 28 extending thereinto from substantially opposite sides of the top side face 30 thereof. Slots 28, in the preferred embodiment, are perpendicular to the axis of the mating portion of the contacts in the connector. Thus slots 28 are also perpendicular to the direction of mating of connectors 10 and 12 and therefore perpendicular to the direction of forces tending to unmate the connectors. Cover 32 is typically secured to back shell 26 by screws (not shown). Cover 32 has protrusions 34 which are adapted to extend into slots 28 when cover 32 is mounted on back shell 26, as shown in FIG. 3.

Figure 4:
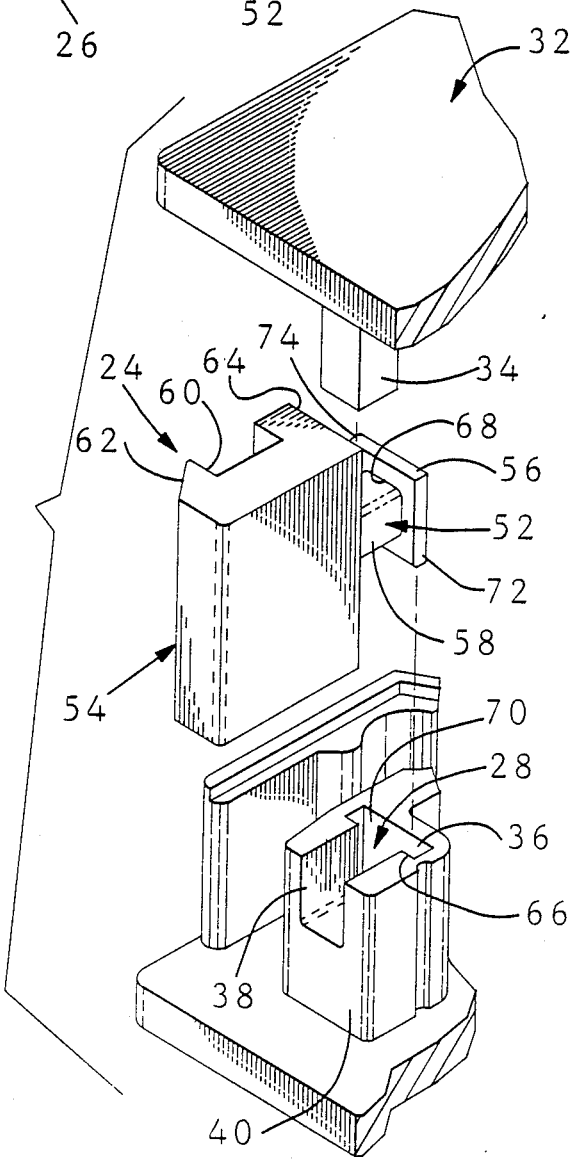
FIG. 4 is an exploded perspective view of a portion of a connector of FIG. 1.

As best seen in FIG. 4, slots 28 have a wider region and a narrower region. In the preferred embodiment, slots 28 have a generally T-shaped configuration when viewed from the top, and include an enlarged first slot portion 36 as the wider region and a second slot portion 38 of reduced size as the narrower region. Slot portion 36 is both wider and deeper than slot portion 38; slot portion 38 opens onto and extends from slot portion 36 to and opens onto the front end face 40 of lower back shell 26. When viewed from the front en 40, as shown in FIGS. 2 and 3, the slot portions 36 and 38 are of generally rectangular shape. The sidewalls o: the slot portions 36,38 include first upper sidewall portion 44,46 respectively, which are tapered inwardly from top surface 30 and second lower sidewall portions 48 and 50, respectively, which are substantially parallel.

As best seen in FIG. 4, removable latch block 24, which is preferably made of a die-cast zinc, includes a retaining section 52 and a latching section 54. Retaining section 52 is adapted to extend into and be received within slot 28 of a connector, and includes an enlarged first retaining portion 56 and a second retaining portion 58 of reduced size. Latching section 54 comprises latch shoulder 60 and tapered surface 62 and is adapted to extend outwardly of slot 28 beyond front end face 40 to cooperate with second latch end 22 of a latch arm 14 in a complementary connector to latchingly secure mated connectors together. Tapered surface 62 extends from proximate latch shoulder 60 back over the latch shoulder in the direction of the distal end which extends outwardly of slot 28.

Enlarged first retaining portion 56 of removable latch block 24 preferably has a polygonal cross-section and is adapted to be received in enlarged first slot portion 36 of slot 28. In a preferred embodiment, the polygonal cross-section is rectangular. The polygonal shape of retaining portion 56 maintains the orientation of removable latch block 24 once inserted into the slot in a preselected orientation.

Second retaining portion 58 can take on any geometry, is adapted to interconnect latching section 54 and enlarged first retaining portion 56, and is adapted to be received in second slot portion 38. The orientation of removable latch block 24 and slot 28 can be maintained by the geometry of second retaining portion 56 closely received in second slot portion 36, such as when second retaining portion 58 has a cross-section that is polygonal and second slot portion 38 has substantially parallel side walls.

Removable latch block 24 also includes flange 64 which is positioned against front end face 40 and lower back shell 26 when removable latch block 24 is positioned within slot 28. Flange 64 also provides additional strength to removable latch block 24.

Slot 28 and the retaining section 52 of removable latch block 24 are sized so that removable latch block 24 fits within slot 28 with a rather close fit such that when the removable latch block is positioned within a slot, it will be unable to move longitudinally or laterally to any significant extent. The tapered upper wall portions 44 and 46 of the slot assist in inserting the removable latch block into the slot. In addition, corner 66 of the enlarged first slot portion and corner 68 of the removable latch block between retaining portions 56 and 58 are somewhat rounded to urge the removable latch block rearwardly into the slot against the back surface 70 as a removable latch block is inserted into the slot to assist in positioning the removable latch block.

The removable latch block is aligned with and inserted into the slot after rotating the removable latch block to orient latching section 54 to a desired orientation. After the removable latch block is inserted into the slot in the selected orientation, the opposed side faces of the polygonal enlarged first retaining portion 56 of removable latch block 24 are parallel to the parallel lower side wall portions 48 of the enlarged first slot portion are parallel to lower side wall portions 48 and fit very closely therebetween such that the removable latch block is thereafter prevented from rotating to any appreciable extent within the slot. In this manner, the enlarged first retaining portion is adapted to cooperate with the lower sidewall portions of slot portion 36 to prevent rotation of the removable latch block. Similarly, opposed side faces of second retaining portion 58 of a particular geometry can be received between second lower sidewalls portions 50 to prevent removable latch block 24 from rotating to any appreciable extent within slot 28. In this manner, the second retaining portion 58 is adapted to cooperate with lower sidewall portions of slot portion 38 to prevent rotation of the removable latch block. Thus, when removable latch block 24 is inserted into slot 28, the removable latch block will be accurately positioned within the slot and is prevented from rotating and moving either laterally or longitudinally within the slot.

In the preferred embodiment, the removable latch block 24 is secured in position in the slot when cover 32 is mounted to the lower back shell 26. As shown in FIGS. 2 through 4, cover 32 includes a pair of projections 34 which extend downwardly from the inside surface thereof. When cover 32 is mounted to back shell 26, the projections 34 extend into slots 28 and the tips thereof press against second retaining portions 58 of removable latch block 24, as shown in FIG. 3, thereby securing the removable latch block 24 in the slots and preventing the removable latch block from moving up or down in the slots. By extending between flange 64 and enlarged first retaining portion 56 of removable latch block 24, projections 34 also assist in preventing longitudinal movement of the removable latch block in the slots. Other means of retaining the removable latch blocks in slots 28 are contemplated within the scope of the invention. Either enlarged first retaining portion 56 or second retaining portion 58 could be received in respective portions of slot 28 in an interference fit. Alternatively, either first retaining portion 56 or second retaining portion 58 could pass over a protrusion in their respective portions of the slot to secured removable latch block 24 in slot 28.

Figure 5:
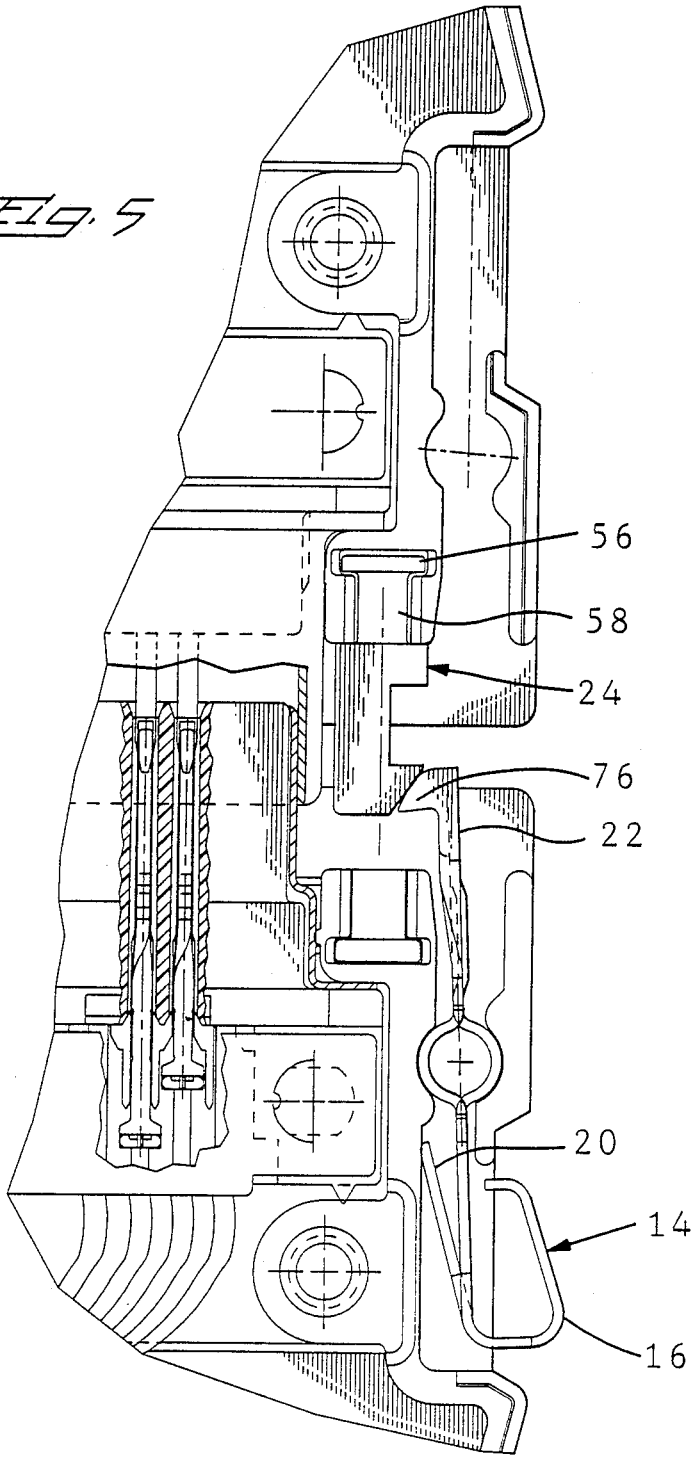
FIG. 5 is a partial view of the connectors of FIG. 1 with the removable latch block in the plug assembly.

When connectors 10 and 12 are aligned for mating, tapered latch ear 76 of first end 16 of latch arm 14 engages inclined surface 62 on removable latch block 24. As connectors 10 and 12 are mated, first end 16 slides along surface 62 depending upon the degree to which second latch end 22 is pressed. The reactionary forces between surface 62 and first end 16 cause, as seen in FIG. 5, latch arm 14 to pivot in a first direction of rotation compressing spring 20. When latch ear 76 clears latch shoulder 60, latch ear 76 moves laterally inwardly along latch shoulder 60 to latchingly secure connectors 10 and 12 together as spring 20 causes latch arm 14 to pivot in a second, opposite direction of rotation.

FIG. 5 also shows that latch arm 14 and removable latch block 24 may be mounted either in plug connector 10 or receptacle connector 12. Connector 10 has insulation piercing contacts 78 for insulation displacement termination to conductors 80 of cable 82 terminated therein. Connector 12 has insulation piercing contacts 84 for insulation displacement termination to conductors 86 of cable 88 terminated therein. The mating portions of contacts 78 and 84 are axially aligned in the direction of mating of connectors 10 and 12. Cables 82 and 88 may be provided with strain relief 90 in any known manner.

I claim:

1. An electrical connector comprising:

a housing having a channel therein, said channel having a wider first region and a narrower second region, said narrower second region opening onto the wider first region and an exterior surface of the housing; and a latch block, said latch block having a latching section and a retaining section, said latching section having a latching shoulder for engagement by latching means on a complementary connector when mated with said connector, said retaining section having an enlarged first retaining portion slidingly received in the wider first region of the channel, said retaining section having a narrower second retaining portion extending from said enlarged first retaining portion through the narrower second region of the channel to interconnect said enlarged first retaining portion with said latching sections.

2. An electrical connector as recited in claim 1, further comprising means for retaining said latch block in said channel.

3. An electrical connector as recited in claim 2, wherein the means for retaining the latch block in said channel comprise a protrusion on a cover, said protrusion adapted to extend into said channel to prevent said latch block from being removed therefrom when said cover is mounted on the connector.

4. An electrical connector, comprising:

a housing having a channel therein, said channel having a wider first region and a narrower second region said narrower second region opening onto the wider first region and an exterior surface of the housing; and a latch block, said latch block having a latching section and a retaining section, said latching section adapted to extend out of said channel beyond the exterior surface of the housing, said latching section having a latch shoulder facing said retaining section, said retaining section having enlarged first retaining portion slidingly received in the wider first region of the channel, said retaining section having a narrower second retaining portion extending therefrom and adapted to be received in the second region of the channel, said channel being sized to receive said retaining section of said latch block with a close fit to prevent any significant movement of said latch block within said slot.

5. An electrical connector as recited in claim 4 wherein said wider first region further comprises opposed side walls which are adapted to cooperate with said enlarged first retaining portion of said latch block to prevent rotation of said latch block within said channel, thereby retaining said latching section in a predetermined orientation.

6. An electrical connector as recited in claim 5 wherein said narrower second region further comprises opposed side walls which are adapted to cooperate with said narrower second retaining portion of said latch block to prevent rotation of said latch block within said channel, thereby retaining said latching section in a pre-determined orientation.

7. An electrical connector as recited in claim 4 wherein said first and second regions include lower side wall portions which are substantially parallel to one another, said lower side wall portions of said first region cooperating with opposite sides of said enlarged first retaining portion of said latch block to prevent rotation of said latch block within said channel and to retain said latch block in said selected orientation.

8. An electrical connector as recited in claim 7 wherein said latch block and said channel include curved surface portions for assisting in positioning said latch block in said channel.

9. An electrical connector as recited in claim 4 further comprising retaining means comprising a projection on a cover structure adapted to extend into said channel for preventing removal of said latch block from said channel.

10. An electrical connector as recited in claim 4 wherein said connector includes a pair of spaced channels for receiving a pair of latch blocks therein.

11. A latch block for reception in a channel in an electrical connector, said channel having a wider first region and a narrower second region, said narrower second region opening both onto the wider first region and an exterior surface of the connector, said latch block comprising:

a latching section and a retaining section, said latching section having a latching shoulder for engagement by latching means, said retaining section having an enlarged first retaining portion adapted to be slidingly received in the wider first region of the channel and a narrower second retaining portion extending from said first retaining portion and adapted to be slidingly received in and extend through the narrower second region of the channel to interconnect said enlarged first retaining portion with said latching section, whereby upon sliding the latch block into the channel and mating a complementary connector to the electrical connector, latching means on the mating connector engage the latch shoulder to latchingly secure the connectors together.

12. A latch block as recited in claim 11 wherein the enlarged first retaining portion is adapted to cooperate with the wider first region of the channel to prevent rotation of the latch block when said latch block is received in said channel.

13. A latch block as recited in claim 12 wherein the enlarged first retaining portion is polygonal in shape.

14. A latch block as recited in claim 11 wherein the second retaining portion is adapted to cooperate with the narrower second region of the channel to prevent rotation of the latch block when said latch block is received in said channel.

15. A latch block as recited in claim 14 wherein the second retaining portion is polygonal in cross-section.

16. A latch block as recited in claim 11 wherein the latch shoulder faces said retaining section.

* * * * *